US005322460A

United States Patent [19]

Hass et al.

[11] Patent Number: 5,322,460

[45] Date of Patent: Jun. 21, 1994

[54] RECEPTACLE TERMINAL HAVING RETENTION MEANS

[75] Inventors: Jürgen Hass, Erzhausen; Matthias Pfaff, Offenbach, both of Fed. Rep. of Germany

[73] Assignee: The Whitaker Corporation, Wilmington, Del.

[21] Appl. No.: 137,899

[22] Filed: Jun. 21, 1993

Related U.S. Application Data

[63] Continuation of Ser. No. 568,004, Aug. 16, 1990, abandoned.

[30] Foreign Application Priority Data

Dec. 23, 1988 [GB] United Kingdom ..... 8830165

[51] Int. Cl.[5] ..... H01R 13/00

[52] U.S. Cl. ..... 439/849

[58] Field of Search ..... 439/845, 849, 850, 885

[56] References Cited

U.S. PATENT DOCUMENTS 1,995,115 3/1935 Douglas ..... 439/849
2,336,385 12/1943 Batcheller ..... 439/849
2,579,739 12/1951 Hayes ..... 439/849
2,727,299 12/1955 Klumpp, Jr. ..... 439/885
3,315,219 4/1967 Brisnser et al. ..... 439/849
4,712,299 12/1987 Loewen et al. ..... 439/885

*Primary Examiner*—Joseph H. McGlynn
*Attorney, Agent, or Firm*—Eric J. Groen; Bruce J. Wolstoncroft

[57] ABSTRACT

Receptacle terminal (2) has a web portion (18) and resilient sidewalls (20) which extend in one direction from the web (18). The sidewalls (20) extend inwardly over the web (18) and have free edge portions (22) which are spaced from the web (18) and which engage a tab (6) which is inserted into the receptacle terminal (2). The receptacle terminal (2) has first terminal engagement means (24, 26, 28) which cooperate with a leading portion (30) and an opening (40) of the tab (6) to position the receptacle terminal (2) in a preassembled position when the tab (6) is inserted onto the receptacle terminal (2). Second terminal engagement means (32) are provided on receptacle terminal (2) proximate inner end (14). The second terminal engagement means (32) cooperate with the opening (40) of tab (6) to position the receptacle terminal (2) in a fully assembled position when the tab (6) is inserted onto the receptacle terminal (2).

12 Claims, 2 Drawing Sheets

RECEPTACLE TERMINAL HAVING RETENTION MEANS

This application is a continuation of application Ser. No. 07/568,004 filed Aug. 16, 1990, now abandoned and a continuation of International Application number PCT/US89/05591 filed 14 Dec. 1989.

The invention relates to an electrical receptacle terminal of the type intended to receive a flat rectangular terminal tab. In particular, the invention is directed to a receptacle terminal which has a retention means to maintain the tab in various positions relative to the receptacle terminal.

U.S. Pat. No. 3,976,348 (U.S. Reissue Pat. No. 30,277) discloses a stamped and formed electrical terminal receptacle which is dimensioned to receive a terminal tab having a rectangular cross section. The receptacle terminal is of the type having a web and having sidewalls which extend from the marginal side portions of the web. The sidewalls are formed inwardly towards each other and towards the web so that a terminal tab can be inserted between the surface of the web and the free edge portions of the sidewalls. Terminals of this general type are widely used for the reason that they can be mated with standard terminal tabs having a rectangular cross section. The terminal receptacle described in U.S. Pat. No. 3,976,348 has a tongue extending from the web at the tab receiving end of the receptacle. The tongue is reversely bent at the tab receiving end and has an intermediate portion which engages an inserted tab. The free end of the tongue extends beyond the receptacle section or portion of the terminal and is engageable so that it can be flexed towards the web. The intermediate portion of the tongue has a locking lance which is received in an opening in the tab which locks the tab to the terminal receptacle upon insertion. The tab can be disengaged by simply flexing the tongue towards the web portion of the terminal.

Terminal receptacle having locking features are being used to an increasing extent on a variety of types of electrical equipment. The provision of preventing disengagement of the receptacle from an inserted tab is highly desirable for reasons of improved reliability and safety. Terminal receptacles which are used under circumstances where unauthorized tampering may be a problem can be provided with the locking feature of the above identified U.S. Patent to eliminate problems with unauthorized or mischievous meddling.

Tab type terminals intended to be mated with receptacles as described above are manufactured in two standard widths, 4.7 mm and 2.8 mm. Heretofore receptacle terminals having locking lances have generally been manufactured for terminals having the greater width, for the reason that is impractical to simply scale down or reduce the size of the receptacle and the locking lance so that the receptacle will accept a terminal tab having a width of 2.8 mm. However, U.S. Pat. No. 4,534,613 is directed to the achievement of a receptacle terminal which has a locking lance and which is dimensioned to receive the smaller standard tab therein.

U.S. Pat. No. 4,534,613 discloses a receptacle terminal which has a substantially flat web portion and contact springs which extend in one direction from the side edge portion of the web. The contact springs extend inwardly over the web and have end portions which are spaced from the web and which engage an inserted tab. A first pair of positioning ears are provided at the mating end of the terminal and extend inwardly of the web and towards each other. A second pair of positioning ears are formed from the contact springs and extend towards each other. The positioning ears locate a tab centrally on the web. A locking lance is struck from the web and serves to lock an inserted tab to the receptacle. This configuration allows the receptacle to be cooperate with the smaller standard tabs (2.8 mm).

The locking lances described cooperate with the tab terminal when the tab is fully inserted or fully assembled into the receptacle terminal. However, in many instances it would prove beneficial if an additional locking feature was provided which would maintain the tab terminal in a preassembled position relative to the receptacle terminal.

The present invention is directed to an electrical receptacle terminal which receives a tab terminal therein. The receptacle terminal has a mating end and an inner end. A web portion extends from the mating end to the inner end, the web portion has resilient sidewalls which extend therefrom. The resilient sidewalls are formed inwardly towards each other and towards one surface of the web, such that free edge portions of the sidewalls are spaced from a surface of the web by a distance which is less than the thickness of the tab terminal. Upon movement of the tab terminal into the receptacle terminal, the free edge portions of the sidewalls will press the tab terminal against the web.

The electrical receptacle terminal is characterized in that first and second tab engagement means are provided thereon. The first tab engagement means are provided proximate the mating end of the receptacle terminal, and the second tab engagement means are provided proximate the inner end of the receptacle terminal. Upon insertion of the tab terminal in the receptacle terminal, the first tab engagement means will cooperate with the tab terminal to position the tab terminal and receptacle terminal in a preassembled condition. Upon further insertion, the second tab engagement means will cooperate with the tab terminal to position the tab terminal and the receptacle terminal in a fully assembled condition.

An embodiment of the invention will now be described by way of example with reference to the accompanying drawings, in which.

Figure 1:
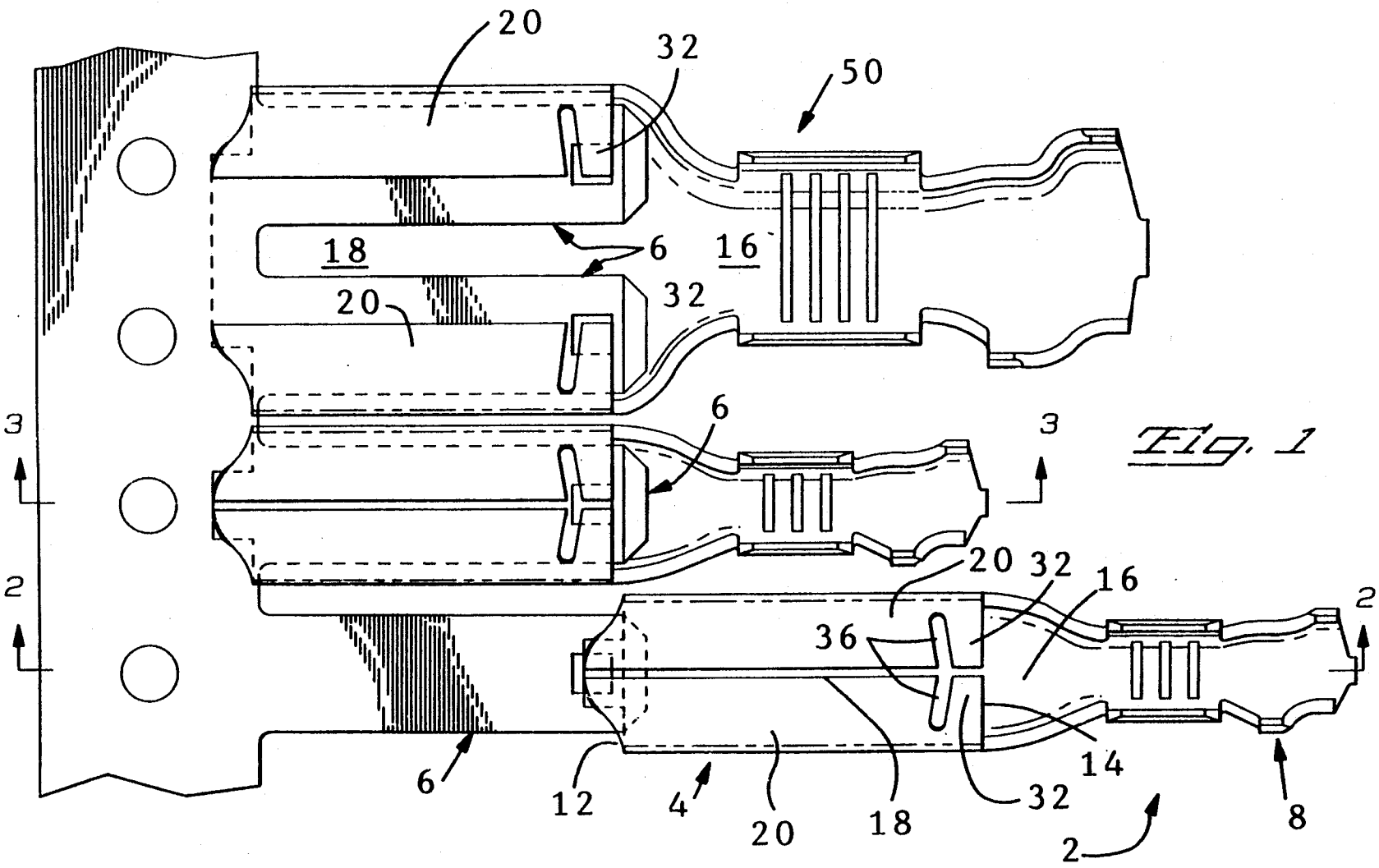
FIG. 1 is a top plan view showing several receptacle terminals of the present invention, two of the receptacle terminals are fully inserted onto respective tab terminals, while the other receptacle terminal is shown in the preassembled position.

As best shown in FIG. 1, a receptacle terminal 2 in accordance with the invention has a wire receiving end 8 which is crimped onto an insulated wire by means of an insulation crimp and a wire crimp which establishes electrical contact between the terminal and the metallic core of the wire. The terminal is of stamped and formed conductive sheet metal and has a receptacle portion 4 which receives a rectangular tab 6 therein. The terminal has a mating end 12, an inner end 14, and a transition section 16 which extends from the inner end to the wire receiving end.

Figure 4:
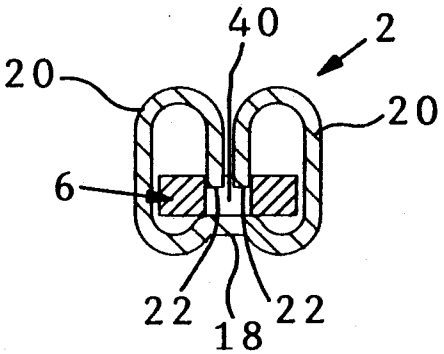
FIG. 4 is a cross-sectional view taken along line 4—4 of FIG. 3, showing the locking ears of the receptacle terminal position in the opening of the tab terminal when the receptacle terminal is in the fully inserted position.

The receptacle portion 4 comprises a web 18 which extends from the mating end 12 to the inner end 14. Sidewalls 20 extend from marginal side portions of the web. As shown in FIG. 4, sidewalls 20 extend from the side portions of the web and are reversely bent through an angle of 180 degrees, so that free edge portions 22 extend normally toward the web. The sidewalls are bent towards each other, similar to that as shown in FIG. 4. It is important to note that the free edge portions 22 of sidewalls 20 are spaced from the surface of web 18 when the sidewalls are bent into position. The spacing provided between the free edge portions 22 and web 18 is less than the thickness of the tab. Many configurations of sidewalls 20 are possible, however free edge portions 22 must be spaced from web 18 in order to allow for the insertion of tab 6 into receptacle portion 6 of terminal 2.

Figure 2:
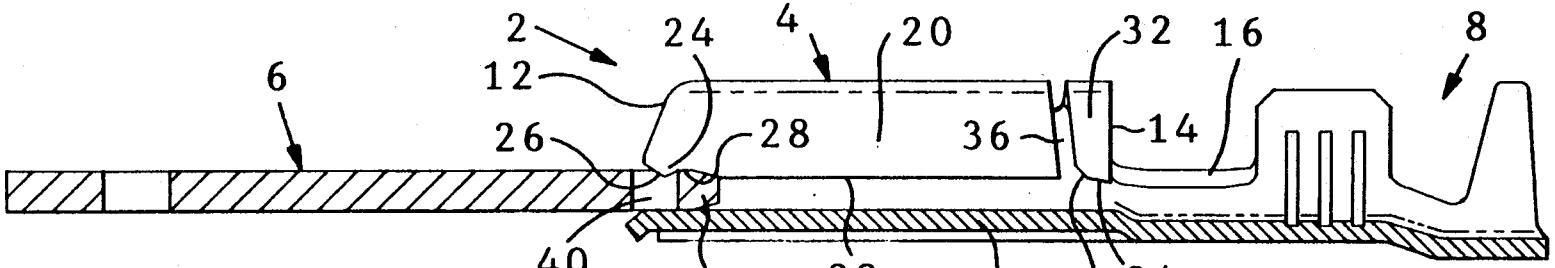
FIG. 2 is a cross-sectional view taken along line 2—2 of FIG. 1, showing the receptacle terminal in the preassembled position.
Figure 3:
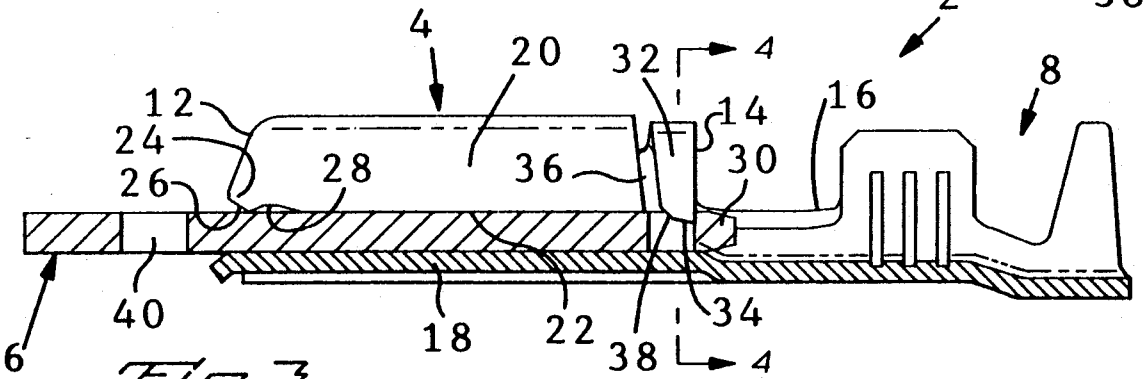
FIG. 3 is a cross-sectional view taken along line 3—3 of FIG. 1, showing the receptacle terminal in the fully inserted or assembled position.

Provided on free edge portions 22 of sidewalls 20, proximate mating end 16, are tab engagement projections 24. Projections 24 extend from free edge portions 22 toward web 18, as is shown in FIGS. 2 and 3. As can be seen in FIGS. 2 and 3, each tab engagement projection 24 is essentially triangular in shape, with the base of the triangle being integral with the respective sidewall. A leading sloping surface 26 of each tab engagement projection 24, as shown in FIGS. 2 and 3, is utilized as a lead in surface, as will be discussed.

Recesses 28 are provided on free edge portions 22 proximate the tab engagement projections 24. The recesses are positioned closer to inner end 14 than are projections 24. The configuration of the recesses is such so as to allow the respective leading portion 30 of the tab 6 to be inserted therein. In the embodiment shown, recesses 28 have a configuration which is identical to the configuration of leading portions 30 of tabs 6. However, the configuration of recess 28 does not have to be identical to the configuration of the leading portions of the tabs.

Locking ears 32 are provided on sidewalls 20, proximate inner end 14. The locking ears cooperate with the tab 6 to maintain the tab in positive electrical connection with the receptacle terminal, as will be more fully described below. The locking ears 32 comprise flanges which extend from the web 18 of receptacle portion 4. The flanges are reversely bent through an angle of 180 degrees as shown in FIG. 4, so that their free end portions 34 extend normally toward the web. The shape of locking ears 32 is essentially identical to the shape of sidewalls 20, when both sidewalls 20 and locking ears 32 are in an unstressed position, as shown in FIG. 2.

As is best shown in FIGS. 2, slots 36 separate locking ears 32 from sidewalls 20, thereby allowing locking ears 32 and sidewalls 20 to move independently from each other. Lead-in surfaces 38 are provided on locking ears 32 proximate free end portions 34. The lead-in surfaces 38 are provided adjacent slots 36 in order to prevent the tab 6 from stubbing against the locking ears 32 as the tab is inserted into the receptacle terminal 2.

In use tab 6 must be positively mated with terminal 2 in order to provide the electrical characteristics required for proper operation. It is therefore important that the terminals be inserted onto the tabs in such a manner so as not to damage either the tabs or the terminals during insertion.

As shown in FIG. 1, the insertion of terminal 2 onto tab 6 is essentially a two step process. The first step consists of positioning a terminal 2 in alignment with a respective tab 6. The terminal 2 is then partially inserted onto tab 6, as is shown in FIGS. 1 and 2, such that the tab is received in the receiving channel of the terminal 2. As insertion occurs, leading portion 30 of tab 6 engages surfaces 26 and web 30 of receptacle portion 4. As this initial insertion continues, leading portion 30 causes surfaces 26 to move away from web 30. This movement is facilitated by the resilient nature of sidewalls 20. The initial insertion is complete when leading portion 30 is inserted into receptacle portion 4 such that a first opening 40 of tab 6 is positioned in cooperation with tab engagement projections 24 of sidewalls 20.

In this preassembled position, as shown in FIG. 2, each projection 24 of receptacle portion 4 extends into opening 40 of tab 6. Also, a surface of leading portion 30 is provided in recesses 28. Due to the resiliency of sidewalls 20, tab 6 is positively maintained in the preassembled position. In other words, the resiliency of sidewalls 20 causes projections 24 to move into opening 40, as the sidewalls are moving toward their unstressed position. This positioning of projections 24 in opening 40 provides a means of securing the tab in the preassembled position. The positioning of projections 24 in opening 40 also provides a positive stop means, thereby insuring that the tab will be properly positioned in the preassembled position.

The second step in the assembly process is moving the terminal 2 from the preassembled position to the fully assembled position. The fully assembled position is shown in FIG. 3. It should be noted that the first step and the second step in the insertion process need not be performed at the same time.

In order to move terminal 2 from the preassembled position to the fully assembled position, a force is applied to the terminal in a direction which is essentially parallel to the longitudinal axis of tab 6. This forces causes terminal 2 to move from the position shown in FIG. 2 to the position shown in FIG. 3.

Initially the force applied must be great enough to cause projections 24 to move from opening 40. With projections 24 removed from the opening, the projections are forced to slid across a surface of the tab. As insertion continues, free edge portions 22 are also forced to slid across the surface of the tab. This sliding motion provides a wiping action between terminal 2 and tab 6, thereby insuring that a positive electrical connection will be effected. The amount of wiping action will be dependent upon the resilient characteristics of the sidewalls 20. Consequently, the wiping action can be controlled according to the materials used.

The fully assembled position is reached, as shown in FIG. 3, when free end portions 34 of locking ears 32 are moved into opening 40 of the tab. As slots 36 separate locking ears 32 from sidewalls 20, the locking ears 32 can move independently of sidewalls 20. Consequently, when locking ears 32 are positioned over opening 40, the resilient characteristics of the locking ears forces the free end portions 34 into the opening.

The movement of locking ears 32 into opening 40 prevents further insertion of the terminal onto the tab. As can be seen in FIG. 3, inner end 14 engages a sidewall of opening 40 to prevent further insertion. Consequently, the accurate positioning of the terminal and the tab in the fully inserted position is insured.

The configuration of inner end 14 and the sidewall of the opening prevents the accidental removal of the tab from the terminal. In order to remove the tab from the terminal a significant amount of force must be applied to remove locking ears 32 from opening 40.

Terminals in accordance with the invention can be used as uninsulated terminals if desired. The terminal is simply crimped onto the end of a wire and a tab is inserted into the receptacle portion. In the alternative, an insulating housing can be provided in surrounding relationship to the terminal.

As shown in FIG. 1, the teaching of this invention is not limited to a terminal of a particular size. Terminal 50 is a terminal which is provided in electrical engagement with two tabs 6. The configuration of the terminal 50 is identical to that of terminal 2, with the exception that the web portion 18 has different dimensions. The increased width of the web allows each sidewall to cooperate with a different tab. Consequently, the terminal 50 is placed in electrical engagement with two separate tabs. It should be noted that the operation of the terminal 50 is the same as terminal 2.

It should be noted that the tabs 6 are connected to each other by means of a carrier strip, as shown in FIG. 1. In certain applications this carrier strip can act as a bus bar to electrically interconnect the respective tabs 6 together. This allows a power terminal 50, which is connected to respective tabs 6 to distribute power through the bus bars to various other terminals 2.

Changes in construction will occur to those skilled in the art and various apparently different modifications and embodiments may be made without departing from the scope of the invention. The matter set forth in the foregoing description and accompanying drawings is offered by way of illustration only. It is therefore intended that the foregoing description be regarded as illustrative rather than limiting.

We claim:

1. An electrical receptacle terminal (2) which receives a tab terminal (6), the receptacle terminal (2) having a mating end (12) and an inner end (14), a web portion (18) extending from the mating end (12) to the inner end (14), the web portion (18) having resilient sidewalls (20) which extend therefrom, the resilient sidewalls (20) are formed inwardly towards each other and towards one surface of the web (18), the sidewalls (20) have free edge portions (22) which are spaced from one surface of the web portion (20) by a distance which is less than the thickness of the tab terminal (6) whereby upon movement of the tab terminal (6) into the receptacle terminal(2), the free edge portions (22) of the sidewalls (20) will press the tab terminal (6) against the web portion (20), the electrical receptacle terminal (2) being characterized in that:

first tab engagement means (24) are provided proximate the mating end (12) of the receptacle terminal (2);

second tab engagement means (32) are provided proximate the inner end (14) of the receptacle terminal (2);

whereby the first tab engagement means (24) will cooperate with the tab terminal (6) to position the tab terminal (6) and receptacle terminal (2) in a preassembled condition, and the second tab engagement means (32) will cooperate with the tab terminal (6) to position the tab terminal (6) and the receptacle terminal (2) in a fully assembled condition.

2. An electrical receptacle terminal (2) as set forth in claim 1 characterized in that the second tab engagement means (32) has locking ears (32) which extend from each side of the web portion (8), the locking ears (32) are formed inwardly towards each other and towards the surface of the web portion (18).

3. An electrical receptacle terminal (2) as set forth in claim 2 characterized in that the locking ears (32) have free end sections (34) which are spaced from the one surface of the web portion (18) by a distance which is less than the thickness of the tab terminal (6).

4. An electrical receptacle terminal (2) as set forth in claim 3 characterized in that slots (36) separate the locking ears (32) from the sidewalls (20), thereby allowing the resilient locking ears (32) to move independently of the sidewalls (20).

5. An electrical receptacle terminal (2) as set forth in claim 1 characterized in that the first tab engagement means (24) has tab engagement projections (24) which extend from the sidewalls (20), the tab engagement projections (24) are positioned adjacent the mating end (12) of the receptacle terminal (2).

6. An electrical receptacle terminal (2) as set forth in claim 5 characterized in that the first tab engagement means (24) has recesses (28) provided proximate the tab engagement projections (24), the recesses (28) cooperate with a leading portion of the tab terminal (6) when the tab terminal (6) is inserted into the receptacle terminal (2).

7. An electrical receptacle terminal (2) as set forth in claim 5 characterized in that the tab engagement projections (24) have a lead-in surface (26) provided proximate the mating end (12) of the receptacle terminal (2).

8. An electrical receptacle terminal which receives a tab terminal, the receptacle terminal having a mating end and an inner end, a web portion extending from the mating end to the inner end, the web portion having resilient sidewalls which extend therefrom, the sidewalls being spaced from the web portion to form a receiving channel therebetween, the electrical receptacle terminal being characterized in that:

retention means are provided in the resilient sidewalls of the web portion and extend from the resilient sidewalls into the receiving channel, the retention means has a first tab engagement means provided proximate the mating end, and a second tab engagement means provided proximate the inner end, whereby as the tab terminal is inserted into the electrical receptacle terminal, the retention means cooperate with the tab terminal to insure that the tab terminal is maintained in position.

9. An electrical receptacle terminal (2) as set forth in claim 8 characterized in that the retention means (24,32) of the receptacle terminal (2) cooperate with respective recesses (40) provided in the tab terminal (6), thereby insuring that the tab terminal (6) is maintained in position relative to the receptacle terminal (2).

10. An electrical receptacle terminal (2) as set forth in claim 8 characterized in that the second tab engagement means (32) has locking ears (32) which extend from each sidewall (20), the locking ears (32) are formed inwardly towards each other and towards the surface of the web portion (18).

11. An electrical receptacle terminal (2) as set forth in claim 10 characterized in that the locking ears (32) have free end sections (34) which are spaced from the one surface of the web portion (18) by a distance which is less than the thickness of the tab terminal (6).

12. An electrical receptacle terminal (2) as set forth in claim 11 characterized in that slots (36) separate the locking ears (32) from the sidewalls (20), thereby allowing the resilient locking ears (32) to move independently of the sidewalls (20).

* * * * *